US007073607B2

(12) United States Patent
Campbell, Jr.

(10) Patent No.: US 7,073,607 B2
(45) Date of Patent: Jul. 11, 2006

(54) OPERATING SYSTEM FOR HYDRAULIC ROCK DRILL

(76) Inventor: Paul B. Campbell, Jr., 271 Laymantown Rd., Troutville, VA (US) 24175-6715

( * ) Notice: Subject to any disclaimer, the term of this patent is extended or adjusted under 35 U.S.C. 154(b) by 0 days.

(21) Appl. No.: 10/178,978

(22) Filed: Jun. 25, 2002

(65) Prior Publication Data

US 2003/0006053 A1 Jan. 9, 2003

Related U.S. Application Data

(60) Provisional application No. 60/300,891, filed on Jun. 25, 2001.

(51) Int. Cl.
*B25D 9/00* (2006.01)

(52) U.S. Cl. ..... 173/104; 173/80; 173/206; 173/78

(58) Field of Classification Search ..... 173/105, 173/106, 107, 104, 116, 78, 80, 197, 213, 173/206, 207, 208
See application file for complete search history.

(56) References Cited

U.S. PATENT DOCUMENTS

| | | | | | |
|---|---|---|---|---|---|
| 3,701,386 | A | * | 10/1972 | Feucht | 173/105 |
| 3,822,752 | A | | 7/1974 | Montabert | 173/106 |
| 4,039,033 | A | * | 8/1977 | Salmi | 173/105 |
| 4,103,746 | A | * | 8/1978 | Reynolds | 173/107 |
| 4,126,192 | A | * | 11/1978 | Wallace | 173/105 |
| 4,289,209 | A | * | 9/1981 | Salmi | 173/107 |
| 4,846,288 | A | * | 7/1989 | Hunt | 173/105 |
| 5,117,921 | A | * | 6/1992 | Bartels et al. | 173/105 |
| 5,415,240 | A | * | 5/1995 | Mundjar | 173/105 |

* cited by examiner

*Primary Examiner*—Scott A. Smith

(57) ABSTRACT

A hydraulic rock drill comprises a housing having a piston and valve bore formed therein, a rotation motor, and a fluid connection and fluid reservoir interposed between the housing and the rotation motor. Fluid connections to the hydraulic rock drill comprise a single inlet fluid connection to the housing and a single exhaust fluid connection from the rotation motor. The working shoulder areas of the piston are proportioned so that the exhaust stroke of the piston will pressurize the fluid in the reservoir, providing a fluid inlet source for the rotation motor. When the rotation torque demand increases, pressure in the fluid reservoir and pressure in the fluid inlet connection will rise accordingly, thus providing higher rotation torque while maintaining impact power. When fluid inlet pressure reaches a predetermined limit, rotation and impact will lessen or cease altogether.

1 Claim, 1 Drawing Sheet

OPERATING SYSTEM FOR HYDRAULIC ROCK DRILL

CROSS-REFERENCE TO RELATED APPLICATIONS

This invention is used on the hydraulic rock drill of co-pending applications entitled "Steel Retainer for Rock Drill" and "Valve for Hydraulic Rock Drill", both filed 2002 Jun. 25. This application is entitled to the benefit of Provisional Patent Application Ser. No. 60/300,891, filed 2001 Jun. 25.

BACKGROUND

1. Field of Invention

This invention relates specifically to a hydraulic rock drill designed for small mounted applications, incorporating characteristics that contribute to improved performance and easier maintenance.

2. Description of Prior Art

A percussive rock drill is a device that, in conjunction with a drill bit, uses rotation and percussive energy to drill a hole in rock for purposes of blasting, etc. Every fluid operated percussive rock drill includes certain basic features. A striking piston imparts impact energy to a drill steel and bit, and a valving mechanism directs the working fluid so as to cause reciprocating motion of the piston. A rotation mechanism causes the drill steel to rotate to give the bit a fresh rock surface to strike with each blow, and a drill steel retention mechanism allows retraction of the drill steel and bit when the hole is completed. Flushing fluid (typically air or water) travels through holes in the drill steel and bit to blow rock cuttings out of the drilled hole.

In a typical operation of a hydraulic rock drill, the striking piston is caused to reciprocate by variable hydraulic forces. The drill steel is constrained and located by a chuck mechanism and a steel retainer, and is caused to rotate by a mechanism such as a hydraulic motor driving through a gear reduction. A drill bit is attached to the end of the drill steel, and the combination of impact and rotation causes the drill bit to penetrate the rock. Finally, some type of fluid energy storage mechanism is used to provide relatively constant pressure sources of working fluid for the piston and rotation.

Manufacturers of small drilling rigs, designed to drill holes in the range of 1¼ to 2 inch diameter, typically use hand-held drills that are modified for mounted use. Modifications may be as simple as removing handles and locking control valves in the "on" position. The advantage of using hand-held tools in these applications is the simplicity of fluid connections; one supply and one exhaust hose serve both impact and rotation, as opposed to larger drills in which separate hoses are required for each function. One disadvantage of using hand-held tools is that rotation torque is typically low. Since the rotation robs power from the impact, rotation power is deliberately limited in order to maximize impact power. Another disadvantage is that if the rotation stalls, the impact power continues unabated or even increases, which can cause jamming of the drill bit into the drilled hole.

SUMMARY

An object of the present invention is to preserve the simplified hose connection of a hand-held tool while providing adequate rotation torque for mounted applications. A second object is to provide a means for automatically reducing or stopping the impact if the rotation stalls. A third object is to provide a means for automatically adjusting the available rotation torque in response to drilling requirements.

DRAWING FIGURES

DESCRIPTION OF IMPROVEMENT

Figure 1:
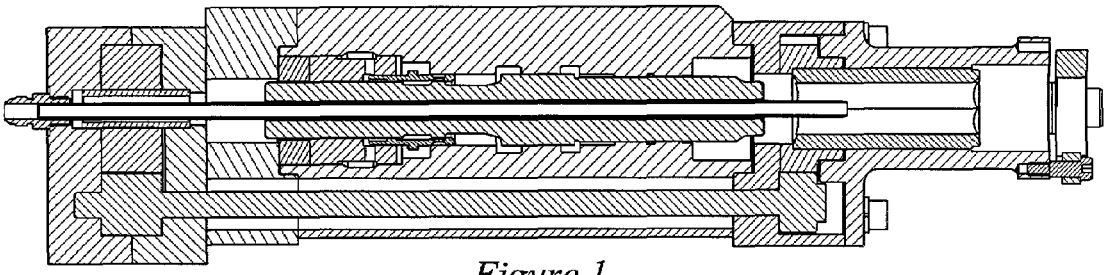
FIG. 1 shows a simplified cross-sectional view of a hydraulic rock drill that embodies the objects of this invention.
Figure 2:
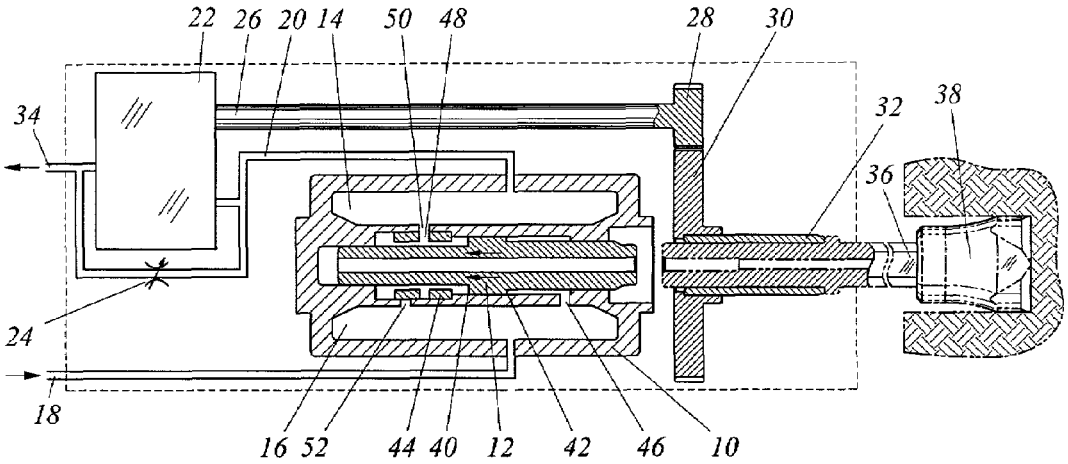
FIG. 2 shows the fluid interconnection between the impact and rotation mechanisms, with the impact piston moving in a return direction.

Conventional hand-held hydraulic drills use a parallel fluid system in which the available fluid flow is divided internally. Most of the flow goes to the impact mechanism but a small portion is diverted to a hydraulic rotation motor. Higher rotation speed requires more flow and hence reduces the available flow to the impact mechanism, whereas lower rotation speed sends more flow to the impact mechanism. In the worst case scenario, the rotation can stall and send all flow to the impact mechanism. In the absence of rotation, the bit no longer has a fresh rock surface on which to impact, and further penetration into the rock is nearly impossible. If operation continues, the usual result is a broken or stuck bit. In a hand-held operation, the operator can compensate for a weak rotation by not pushing the drill bit into the rock with as much force whenever there is a tendency to stall. In a mounted application feed force is fixed, and the only solution to repeated rotation stalling is to reduce the fixed feed force. However, inadequate feed force results in a loss of drilling efficiency. FIG. 2 shows an improved device (the object of this invention) that uses a series fluid system in which flow passes first through the impact mechanism and then through the rotation motor. High pressure reservoir 16 is connected to an external pressure source through passage 18. Intermediate pressure reservoir 14 is connected to rotation motor 22 through passage 20. Exhaust fluid from impact piston 12 accumulates in reservoir 14. The power required to operate the rotation is typically less than one third the power required to operate the impact mechanism, so a rotation motor designed to use most of the available impact exhaust flow can run at low pressure and still deliver adequate torque. Rotation motor speed can be manually adjusted by bypassing a controlled amount of fluid through flow control valve 24 direct to return hose connection 34. Since this bypass flow occurs at low pressure, the power lost to inefficiency is low. Rotation motor 22 turns shaft 26, gear 28, and gear 30. Chuck 32 locates drill steel 36 in the proper position for impact by piston 12 and also transmits the rotation of gear 30 to drill steel 36 and drill bit 38.

The operating system as described will not work properly if a conventional impact device is simply connected in series with an existing rotation motor. The impact device must be specifically designed to use the operating system, as explained below.

Figure 3:
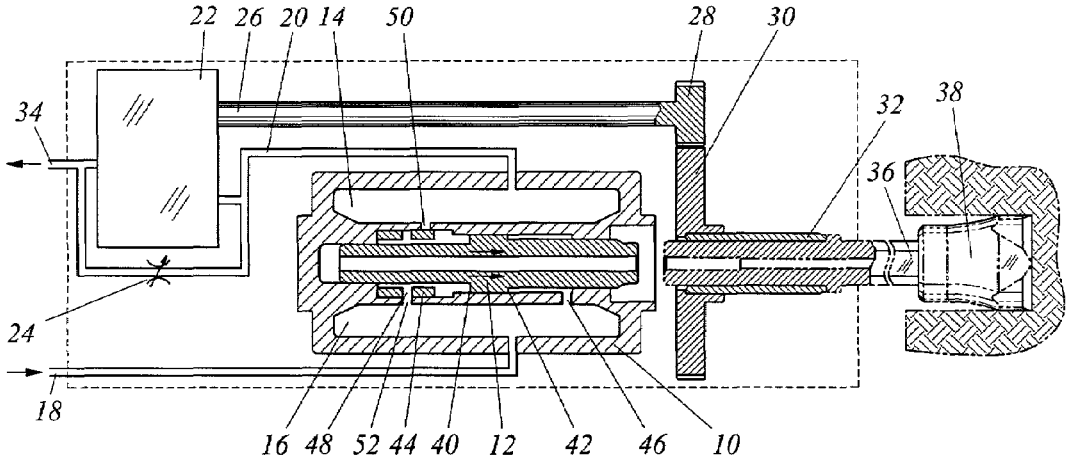
FIG. 3 shows the fluid interconnection between the impact and rotation mechanisms, with the impact piston moving in a drive direction.

Referring to FIGS. 2 and 3, impact piston 12 is reciprocably mounted in housing 10 and is moved in alternate directions by hydraulic forces acting against shoulders 40 and 42. Shoulder 42 is typically connected to high pressure reservoir 16 through port 46 so that shoulder 42 is exposed to a substantially constant high pressure. Shoulder 40 is alternately connected to high pressure reservoir 16 or intermediate pressure reservoir 14 by the action of valve 44. Shoulder 40 is larger than shoulder 42 by a predetermined value such that the area ratio between the two shoulders is fixed. When shoulder 40 is connected to high pressure, impact piston 12 is in drive stroke mode which results in impact against drill steel 36. When shoulder 40 is connected to intermediate pressure, impact piston 12 is in retract or exhaust mode.

In FIG. 2, shoulder 40 is connected to intermediate pressure reservoir 14 through ports 48 and 50. The pressure in high pressure reservoir 16 is considerably higher than the pressure in intermediate pressure reservoir 14 so impact piston 12 is moving leftward even though shoulder 40 is larger than shoulder 42. Hydraulic fluid is being pushed by shoulder 40 into intermediate pressure reservoir 14. Accumulated fluid in intermediate pressure reservoir 14 is a supply source for rotation motor 22 through passage 20. The pressure in intermediate pressure reservoir 14 is a direct function if the torque requirement of motor 22. If the torque requirement of motor 22 is low then the pressure in reservoir 14 is low. Conversely, if the torque requirement of motor 22 is high then the pressure in reservoir 14 must also be high in order to maintain rotation of motor 22. If the pressure in reservoir 14 rises high enough to prematurely stop the leftward motion of impact piston 12, then both motor 22 and impact piston 12 will slow down or stall. If shoulder 40 is too large relative to shoulder 42, ten stalling will occur at too low a pressure in reservoir 14 and the useful torque of motor 22 will be limited. Thus it may be seen that the relationship between shoulder 40 and shoulder 42 is critical to the proper functioning of the operating system that is the subject of this patent. In a typical hydraulic drill, the area of shoulder 40 might be about three times the area of shoulder 42. In a hydraulic drill using the subject operating system, shoulder 40 might be only about two times the value of shoulder 42. In a hydraulic drill using the subject operating system, shoulder 40 might be only about two times the value of shoulder 42.

In FIG. 3, shoulder 40 is connected to high pressure reservoir 16 through ports 48 and 52. Since shoulder 40 is larger than shoulder 42, the net force is to the right and piston 12 moves rightward.

The maximum benefit of this operating system can be realized by operating on a fixed flow hydraulic system wherein normal operation occurs at about 80% of maximum system pressure. For example, suppose the subject hydraulic drill operates normally at 10 gpm (gallons per minute) at 1750 psi (pounds per square inch). Then the appropriate hydraulic system would be a fixed displacement pump delivering ten gpm with a maximum permissible system pressure of about 2200 psi. When a higher torque requirement is encountered, the inlet pressure to the rotation motor automatically increases in an attempt to maintain the same motor flow rate against greater resistance. Since the operating pressure drop across the impact mechanism is nearly constant, an increase in the motor inlet pressure (and hence the impact mechanism exhaust pressure) is answered by an increase in the impact inlet pressure. By this method a higher torque is automatically achieved while maintaining a substantially constant impact power. If the rotation pressure increases too far and the required impact inlet pressure exceeds the maximum system pressure, the impact mechanism and rotation motor will both slow down or stall, alerting the machine operator to take appropriate action. Operation is restored by reducing or removing the feed force, without the necessity of trying to free a stuck bit.

U.S. Pat. No. 3,822,752 (Roger Montabert, Jul. 5, 1974) describes a series fluid system for a hydraulic drill. However, this prior art is more complicated than the present invention and differs in significant other ways. Montabert '752 reverses the order of the current invention by passing the fluid first through the rotation motor and then through the impact mechanism. The invention is shown in two embodiments. The first embodiment uses the same amount of total flow for both rotation and impact functions, and a separate pressure regulator valve is required for proper operation. The second embodiment provides additional flow to the impact mechanism via an additional hose feeding through a pressure compensated flow control valve. In both embodiments, some of the simplicity of the series fluid system is lost because of the requirement for an external control valve. Furthermore, additional rotation torque is achieved only at the expense of rotation speed and impact power. A higher torque requirement increases the resistance to flow, and in a fixed pressure hydraulic system, the flow is automatically reduced when flow resistance increases. The rotation motor is a fixed displacement device with a direct relationship between flow and rotation speed, so lower flow causes the rotation motor to slow down. Pressure drop across the impact mechanism is directly related to flow, so the reduced flow passing through the rotation motor and impact mechanism lowers the impact mechanism inlet pressure and hence the rotation motor exhaust pressure. It is the increased pressure drop across the rotation motor that creates more torque, but the immediate and corresponding effect is a loss of impact power unless additional flow is supplied to the impact mechanism. While reduced impact power with higher torque may be advantageous in some situations, as when encountering varying rock conditions as described in the Montabert patent, it is detrimental in others. Varying rock conditions are not the only situation in which higher rotation torque is required. For example, when drilling larger diameter holes both high rotation torque and high impact power are necessary. The present invention automatically achieves a higher rotation torque when required, without sacrificing impact power.

U.S. Pat. No. 4,039,033 (Pekka M. Salmi, Aug. 2, 1977) describes another variation of a direct connection bet ween the impact mechanism and the rotation motor. In Salmi '033, a portion of the total hydraulic fluid flow is used to activate the valve mechanism tat alternately connects one shoulder of the piston to high or low pressure. After activating the valve mechanism, this portion of the flow is directed into a gas charged accumulator and thence to a rotation motor. The only similarity between Salmi '033 and the present invention is the fact that fluid passes first through the impact mechanism and subsequently to the rotation motor. There are significant differences, leading to the conclusion that Salmi '033 offers none of the advantages offered by the present invention. The operating system in Salmi '033 would most properly be considered a parallel system. i.e. part of the flow goes tote impact piston and part of the flow goes to the rotation motor (by way of the valve mechanism). Consequently, not all of the supplied flow is available to operate the impact piston. In a small hydraulic system with limited flow, this is a serious drawback. Further, an increase in rotation torque requirement causes an increase in rotation motor inlet pressure, which slows the valve mechanism to the detriment of impact power. While this may be an advantage if it is desirable to limit impact power, it is a disadvantage if it is desirable to keep impact power constant while increasing rotation torque. A further disadvantage of Salmi '033 is complication; not only is it necessary to provide a separate rotation motor exhaust connection, but a third fluid accumulator is required. Unlike Salmi '033, the present invention preserves the simplicity of having only two hydraulic connections while automatically achieving a higher rotation torque when required without sacrificing impact power.

CONCLUSION, RAMIFICATIONS, AND SCOPE

The reader will see that the hydraulic drill operating system described herein achieves the following desired advantages

- it preserves the simplicity of the two-hose connection common to hand-held tools, and
- it reduces or eliminates impact after the rotation has stalled, and
- it automatically increases available rotation torque when required, without reducing impact power.

Although the description above contains many specificities, these should not be construed as limiting the scope of the invention but as merely providing an illustration of the preferred embodiment of this invention. For example, in the preferred embodiment the valve is shown as being concentric with the piston. In an alternative embodiment the valve might be a spool valve or other valve means. Likewise in the preferred embodiment the valve and piston are connected to fluid reservoirs. In an alternative embodiment the valve and piston might be connected to nitrogen-charged accumulators. In the example of a typical hydraulic system, a specific pressure and flow mentioned. The subject operating system is not limited to any particular pressure or flow.

Thus the scope of the invention should be determined by the appended claims and their legal equivalents, rather then by the examples given.

I claim:

1. An operating system for a rock drill consisting of a housing a single inlet and a single exhaust connection, an impact piston, an internal fluid reservoir, and a rotation motor, wherein a. all fluid entering said single inlet connection flows sequentially, in series, from said impact piston through said internal fluid reservoir to said rotation motor;

b. said fluid reservoir is the only fluid supply source for said rotation motor;

c. all fluid flowing from said fluid reservoir through said rotation motor exits through said single exhaust connection;

d. said impact piston is driven toward impact by pressure acting against a drive shoulder and is retracted by pressure acting against a return shoulder, whereby said drive shoulder exhausts fluid into said fluid reservoir during retract;

e. flow requirements of said rotation motor are matched to flow requirements of said impact piston so as to utilize all of the exhaust flow from said impact piston for rotation, whereby continuous and simultaneous impact and rotation occurs under all drilling conditions wherein adjustable bypass means is incorporated between said single exhaust connection to divert a percentage of fluid flow around said rotation motor and thus regulate the speed of said regulation motor.

* * * * *